US005129437A

United States Patent [19]

Nettles et al.

[11] Patent Number: 5,129,437

[45] Date of Patent: Jul. 14, 1992

[54] WOOD CHIPPER KNIFE HOLDER WITH REPLACEABLE WEARPLATE

[75] Inventors: Timothy P. Nettles, Carthage; David E. Dillon, Black River; Norman R. Luffman, Watertown; James C. Marti, Lowville; Arthur A. Shattuck, Edwards; Milton E. Howard, Lowville, all of N.Y.

[73] Assignee: Carthage Machine Company, Birmingham, Ala.

[21] Appl. No.: 721,957

[22] Filed: Jun. 27, 1991

[51] Int. Cl.[5] ..... B02C 18/18; B27C 1/00

[52] U.S. Cl. ..... 144/176; 144/162 R; 241/92; 241/298

[58] Field of Search ..... 241/92, 278, 296; 144/162 R, 176

[56] References Cited

U.S. PATENT DOCUMENTS 3,144,995 8/1964 Fontaine ..... 241/92
3,542,302 11/1970 Salzmann ..... 241/92
4,694,995 9/1987 Holmberg et al. ..... 241/92
4,784,337 11/1988 Nettles et al. .
4,887,772 12/1989 Robinson et al. ..... 241/92

*Primary Examiner*—W. Donald Bray
*Attorney, Agent, or Firm*—Wall and Roehrig

[57] ABSTRACT

A knife holder for a rotary type wood chipper is in the form of a segment occupying a segmental portion of the proximal side of the cutting disk and extending to a chip slot of an adjacent knife from its associated knife assembly. The knife holder has a hardened helicoid proximal wear surface that faces the logs that are fed into the chipper. Each knife holder is formed of a base plate which removably mounts onto the disk and a wear plate that is replaceably attached onto the proximal side of the base plate. The wear plate is mechanically attached to the base plate by set screws and is also attached by a weld that runs along a peripheral chamfer. When the hardfacing surface on the wear plate becomes eroded, the wear plate can be removed and replaced.

8 Claims, 6 Drawing Sheets

WOOD CHIPPER KNIFE HOLDER WITH REPLACEABLE WEARPLATE

BACKGROUND OF THE INVENTION

This invention relates to disk-type wood chippers for cutting uniform chips from a log. The invention is more particularly directed to an improved segmental knife holder which supports removable knife blade assemblies on a front face of the chipper disk. The invention is more specifically concerned with a knife holder that has a replaceable wear surface on the side that faces logs being fed into the chipper.

A typical rotary disk type chipper is described in detail in U.S. Pat. No. 4,784,337. In the chipper of this configuration, logs are fed against a rotating disk which carries a number of radially disposed knives clamped between a main portion of the disk and respective segmental or pie-wedge shaped knife holders. In these chippers, the knife holders extend up to a chip slot associated with a successive knife assembly from the knife assembly that it is responsible for clamping. The proximal surface of the knife holder is typically given a hardening treatment, i.e. coated with a hardfacing substance harder than the mild steel of which it is constructed, so that it can endure continuous abrasion from the incoming logs. However, after a period of use, the hardfacing coating on the knife holders will wear or abrade away. This causes portions of the mild steel beneath it to become exposed, and this significantly reduces the efficiency of the chipper. Therefore, the hardface coating on the knife holders must be repaired periodically or the knife holders must be entirely replaced.

The proximal or log-facing surface of the knife holder has a rather complex twisted geometry, that is, it is helicoid rather than flat. This characteristic makes machining of the worn knife holders rather difficult when repair of the hardcoating surface treatment is required.

In the conventional wood chipper, the knife holder is in the form of a one-piece segment with a helicoid surface treated with a hardfacing. When the hardfacing on the helicoid surface wears through, the worn surfaces are welded flush with the hardfacing, and then the entire face is rehardfaced. Additional welding and machining on the back or distal surface of the knife holder segment may be required to bring the thickness of the knife holder back into proper tolerance. In addition, with each successive repair to the segmental knife holder, the geometrical helicoid surface and the hardfacing surface finish each degrade, causing a reduction in the quality of wood chips produced.

For these reasons, it was desired to provide an improved segmental knife holder which avoids these problems and which facilitates knife holder repair without at the same time bringing on new problems such as degradation of wood chip quality.

OBJECTS AND SUMMARY OF THE INVENTION

Accordingly, it is an object of this invention to improve disk type chippers and to avoid the drawbacks of the prior art.

It is a further object of the present invention to provide an improved two-piece segmental knife holder with a replaceable wear plate, thus to facilitate repair to the knife holder when it becomes worn.

It is another object of this invention to provide a segmental knife holder that can be repaired easily without affecting thickness tolerance or varying from the correct geometrical shape of the wear surface.

According to an aspect of this invention, a wood chipper apparatus has a rotary cutting disk on which are mounted a number of spaced radially disposed knife assemblies. Each knife assembly is secured onto a proximal face of the rotary disk by means of a knife holder that occupies a segmental portion of the proximal side of the cutting disk and extends to an adjacent chip slot from its associated knife assembly or assemblies. The knife holders each have a hardened helicoid wear surface or hardfacing that faces the incoming logs as they are being chipped by the rotary cutting disk. According to the present invention, each knife holder comprises a base plate which removably mounts onto the disk, i.e., by bolts or other equivalent fasteners, and a wear plate that is replaceably attached onto the proximal face of the base plate. The wear plate has a helicoid proximal surface on which the hardfacing is formed to a predetermined thickness. Preferably, the base plate and wear plate are each formed of mild steel, and the hardfacing is coated onto the helicoid surface to a thickness of 0.020 to 0.050 inches, and preferably about 0.020 to 0.030 inches. In a preferred mode, the wear plate has a peripheral chamfer on its distal side along one or more of the edges other than the edge adjacent to the knife assembly. The wear plate is disposed in registry with the base plate, and the wear plate and base plate are welded together along their periphery, with the chamfer receiving a weld bead therein. When the wear surface or hard facing of the wear plate becomes eroded, the knife holder is removed from the chipper and the wear plate can be removed from the base plate by cutting through the peripheral weld bead. Then, the proximal surface of the base plate can be easily ground flat to remove any residue of the previous weld. A new wear plate can be installed and welded in place.

The base plate has a plurality of threaded bores that pass through it and the associated wear plate has a like plurality of corresponding threaded bores that extend from the distal surface part way to the proximal surface and in registry with the base plate threaded bores. Set screws are inserted in these bores to join the base plate to the wear plate. This helps support the wear plate at positions away from the peripheral weld. The set screws can be backed out of the threaded bores, prior to a wear plate replacement.

The above and many other objects, features, and advantages of this invention will become apparent from the ensuing detailed description of selected preferred embodiments, which should be read in connection with the accompanying Drawing.

DETAILED DESCRIPTION OF A PREFERRED EMBODIMENT

Figure 1:
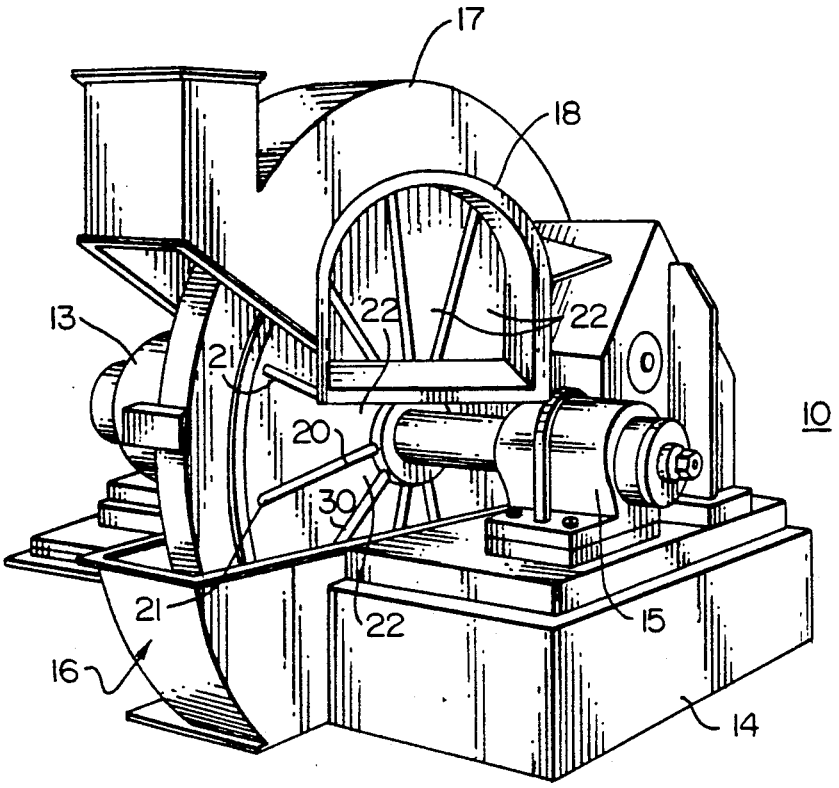
FIG. 1 is a perspective view of a disk type chipper in which the knife holders of this invention can be employed.
Figure 2:
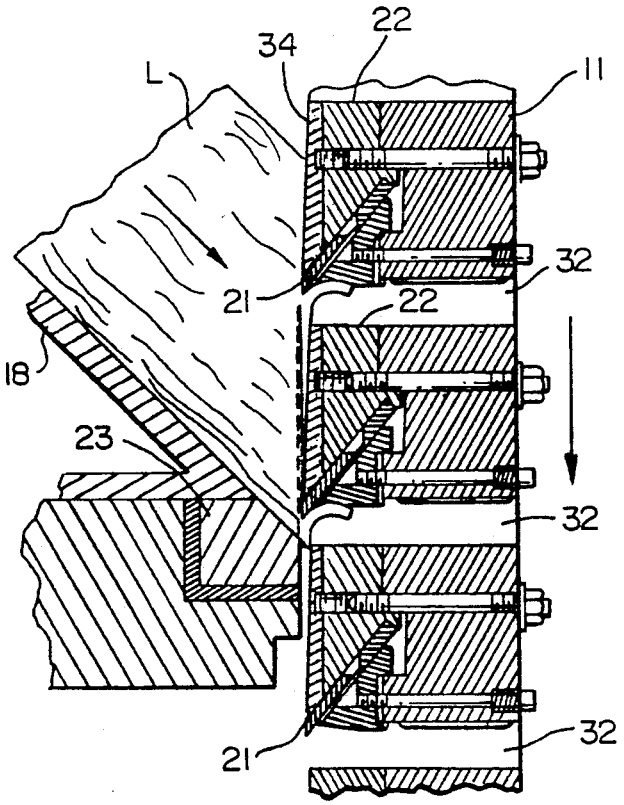
FIG. 2 is a partial sectional view showing a portion of the disk of the chipper of FIG. 1, and further illustrating a log being fed against a succession of disk-mounted cutting stations.

With reference to the Drawing, FIG. 1 illustrates a large-disk-type log chipper 10 of the Carthage-Norman design. The chipper includes a vertically disposed disk 11 that is secured for rotation upon a horizontal drive shaft 12 that is driven by an electric motor 13. The drive shaft is mounted onto a base 14 by suitable journal bearing assemblies 15. A lower part of the disk 11 is shielded by a protective cover 16 while the upper part is enclosed within a removable hood 17, here shown partly lifted away. A log feed chute 18 brings logs against a proximal face of the disk 11. Here the log chute 18 is an over-the-shaft design, and passes through the hood 17 bringing the logs to be chipped to a plurality of radially disposed and angularly separated cutting stations 20. As shown e.g., in FIG. 2, each of the cutting stations 20 has one or more cutting knives 21 secured by a respective segmental knife holder 22 attached onto a proximal face of the disk 11. The feed chute 18 includes a stationery bedknife 23 which cooperates with the rotary knives 21 to cut a log L into substantially uniform chips.

Figure 3:
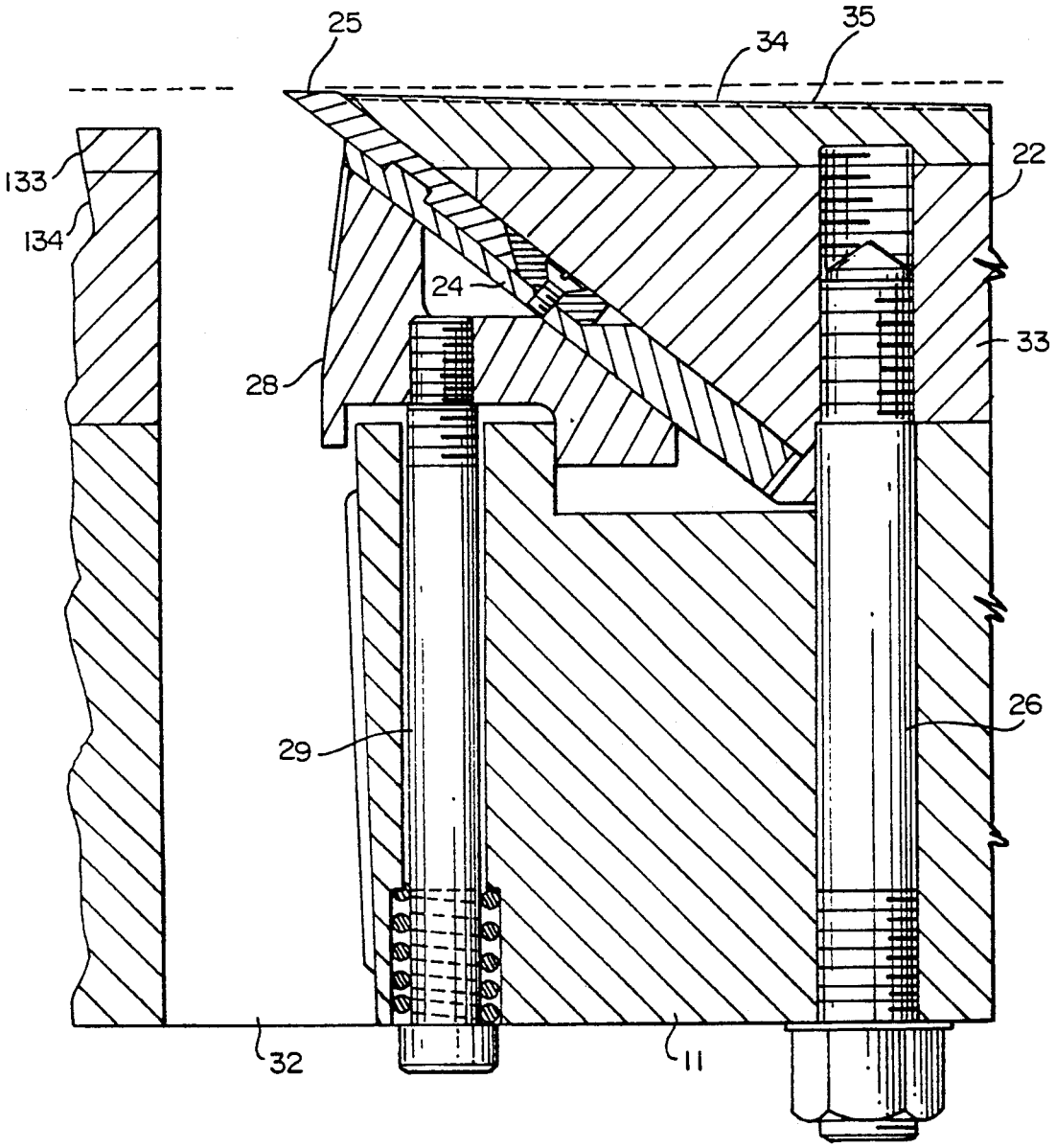
FIG. 3 is an enlarged view of one of the cutting stations illustrated in FIG. 2, and featuring the two-piece knife holder according to an embodiment of this invention.

Each of the knives includes a knife cassette 24, in which is mounted a knife blade 25, which can be of the type described in U.S. Pat. No. 4,784,337. Threaded studs 26 secure the knife holder 22 onto a base portion 27 of the disk 11. A bifurcated clamping member 28 clamps the cutting knife 21 against the knife holder 22 and is held in place by a clamping screw 29. A sloping surface 30 is formed at the distal face of the knife holder and forms a predetermined angle, e.g. thirty degrees to forty degrees, which depends on the nature of the wood chips to be reproduced. A shoulder or step 31 is formed at the distal end of the recessed surface 30. This shoulder 31 positions a back end of the knife 21. A spacer can be formed of babbitt metal and positioned between the shoulder 31 and the knife 21 to place the tip of the blade 25 at a desired location, as shown in FIG. 3. As further shown with reference to FIGS. 4, 5, and 6, the segmental knife holder 22 is generally in the form of a pie-wedge shape segment and is in two parts positioned in registry with one another. To wit, a base member or base plate 33 has a replaceable wear plate 34 disposed on it on the proximal or log-facing side of the base plate 33. A hardfacing coating or treatment 35, typically with a thickness of 0.20 to 0.050 inches, and preferably about 0.030 inches is formed on the helicoid proximal surface of the wear plate 34. It is preferred to form the hardfacing coating 35 of tungsten carbide powder applied in a thermal spray technique. The base plate 33 has a flat proximal surface and the wear plate 34 has a mating flat distal surface.

A number of threaded bores 36 extend through the base plate, and a similar group of blind threaded bores 37 are positioned in registry therewith in the wear plate 34. The bores 37 extend from the distal or back surface partway towards the proximal surface. The aligned threaded bores 36 and 37 permit a set screw 38 or similar threaded fastener to secure the plates 33 and 34 mechanically.

An additional bore 39 in the base plate with an aligned bore 40 in the wear plate permits a dowel 41 to be positioned within the segmental knife holder 22.

Figure 4:
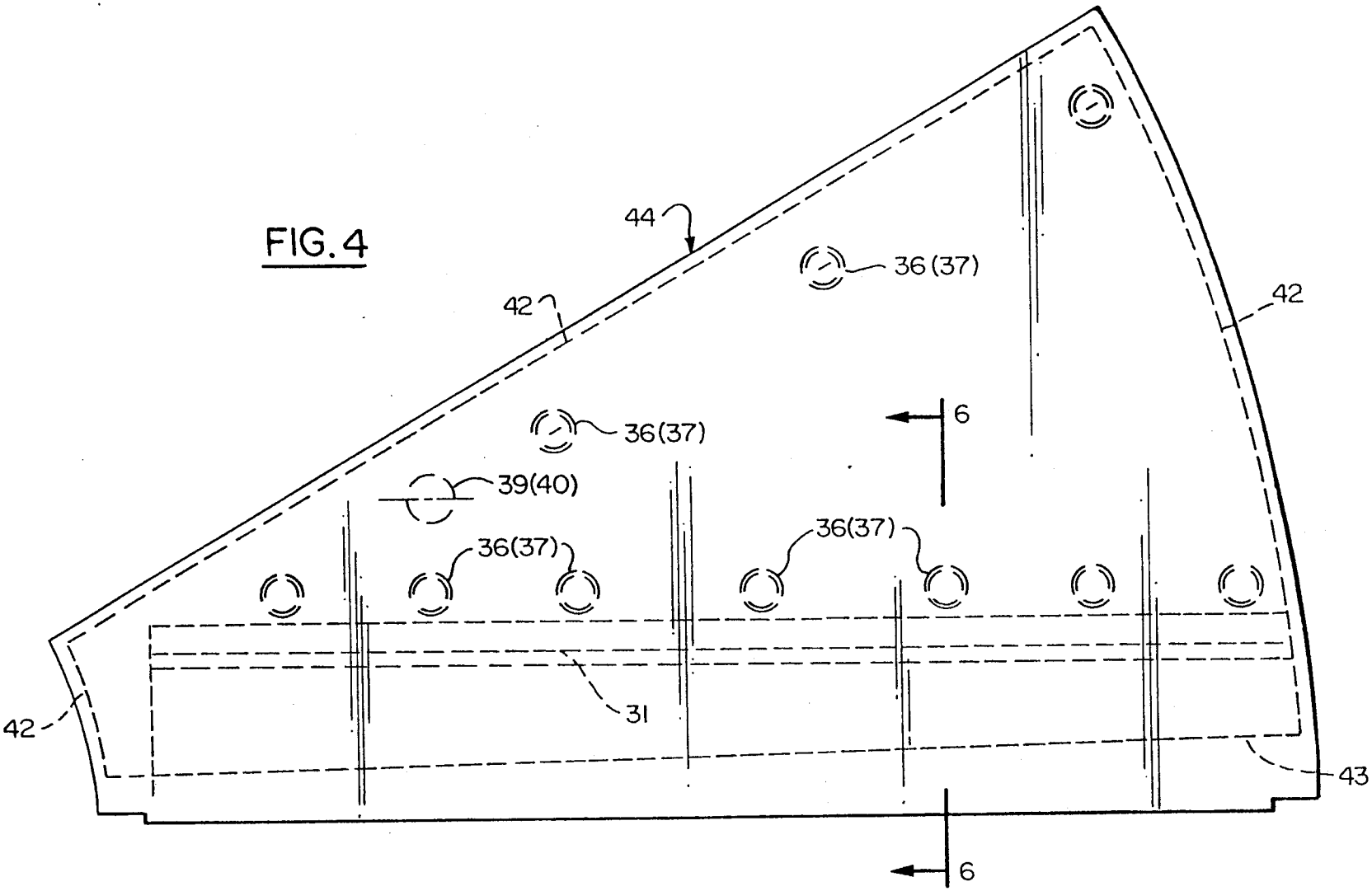
FIG. 4 is a top plan view of a knife holder according to one embodiment of the present invention.
Figure 5:
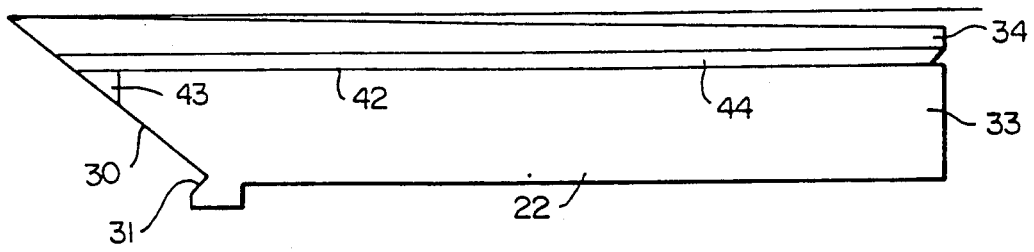
FIG. 5 is a side elevation of the knife holder of FIG. 4.
Figure 6:
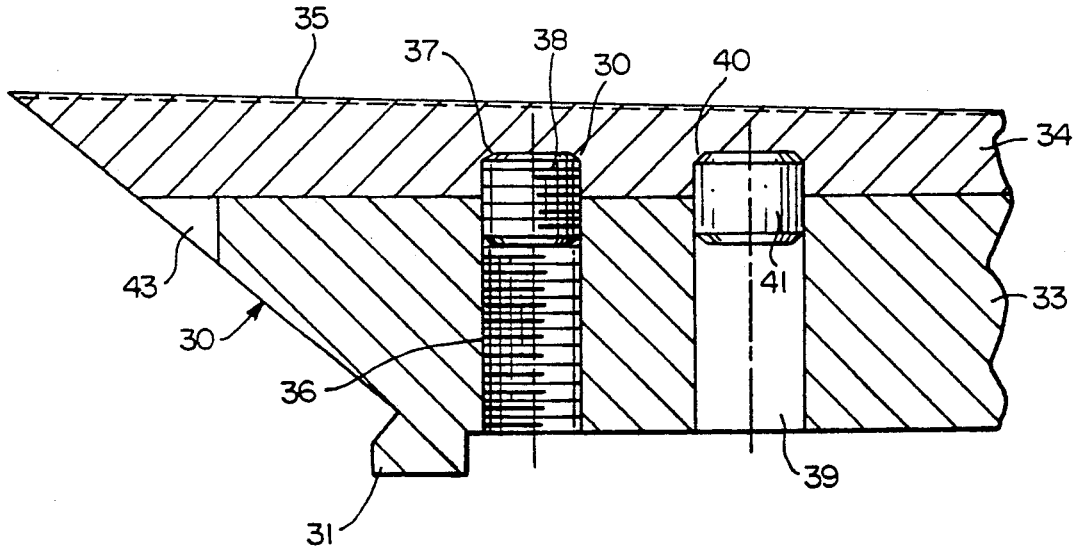
FIG. 6 is a partial sectional view of this knife holder taken at 6—6 in FIG. 4.

A chamfer 42, as shown in FIGS. 4 and 5, extends around the periphery of the wear plate at its distal surface, except along the edge that faces the knife 21. Instead, a cutout 43 is formed adjacent the knife 21 on the proximal side of the base plate 33. Here, the cutout is in the form of a vertical cut. A weld bead 44 is placed along the entire periphery of the interface of the base plate 33 and wear plate 34, and is positioned in the chamfer 42 and cutout 43.

As shown in FIG. 4, there is a set of ten pairs of aligned bores 36, 37. Six of these are disposed adjacent the shoulder or step 31, and serve also the function of receiving the clamping screw 29 that holds the clamping member 28 against the cutting knife or knives 21.

To repair this knife holder 22, when the hardfacing surface 35 becomes damaged, the knife holder 22 is removed from the disk 11, and then the weld bead 44 is cut through, e.g., with a saw. The set screws 38 are removed, and then the wear plate 34 is removed. After suitably grinding and polishing the periphery of the base plate 33, a new wear plate 34 is installed, and this is again secured by the set screws and by the welding at the periphery.

It should be appreciated that this invention permits rapid and reliable field repair of the chipper knife holders, and that this repair can be done without resort to welding or repairing of the hardfacing surface itself. Using the technique of this invention, the entire helicoid surface is replaced together with the wear plate 34, thus eliminating any problems with the repair of this twisted surface. The wear plates for successive repairs can preferably be made somewhat thicker by a small amount, and this permits machining off of the back or distal surface of the holder base plate 33 to provide a freshly machined, true distal surface, with the axial thickness within tolerance.

Figure 7A:
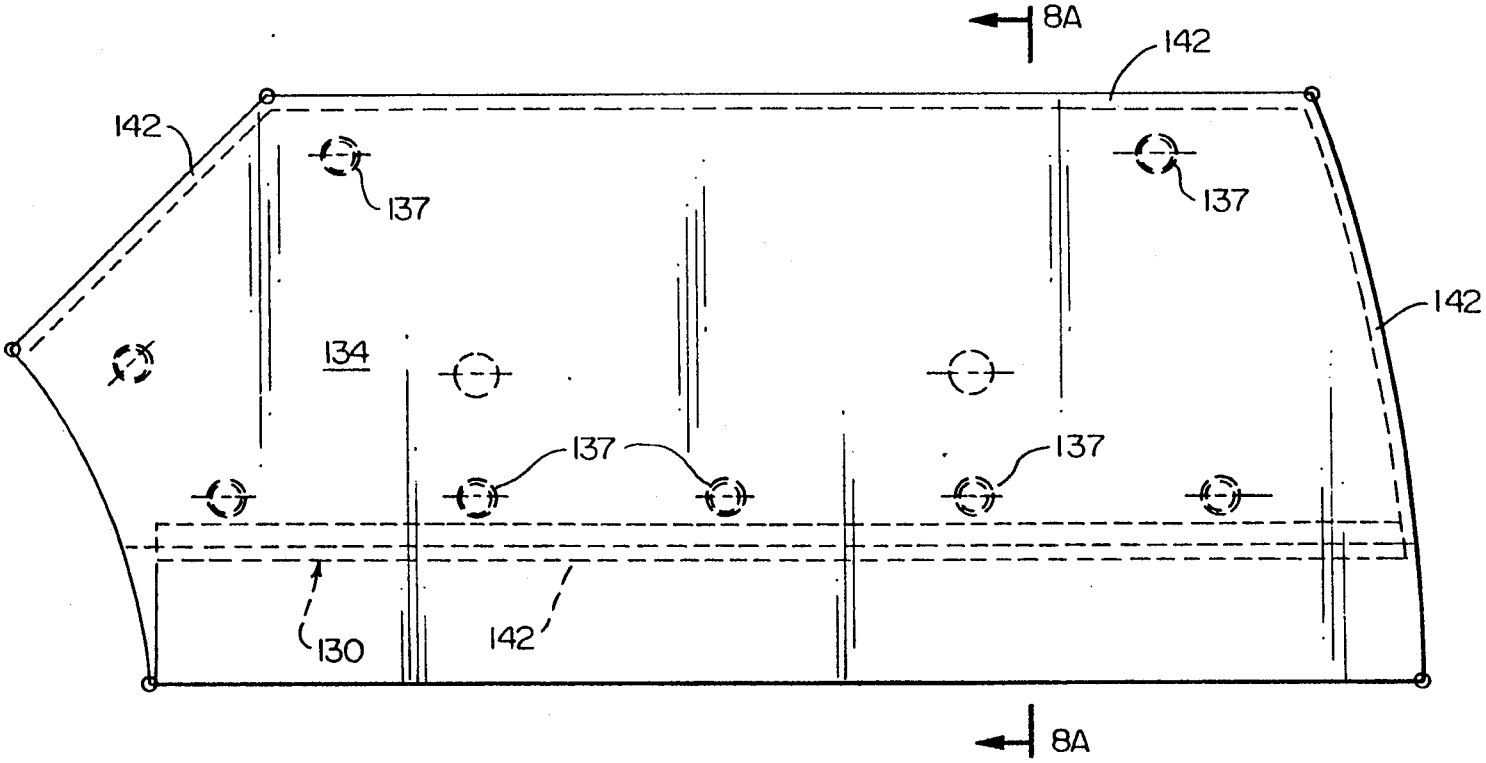
FIGS. 7A and 7B are top plan views of two portions of a two-part knife holder according to another embodiment of this invention.
Figure 7B:
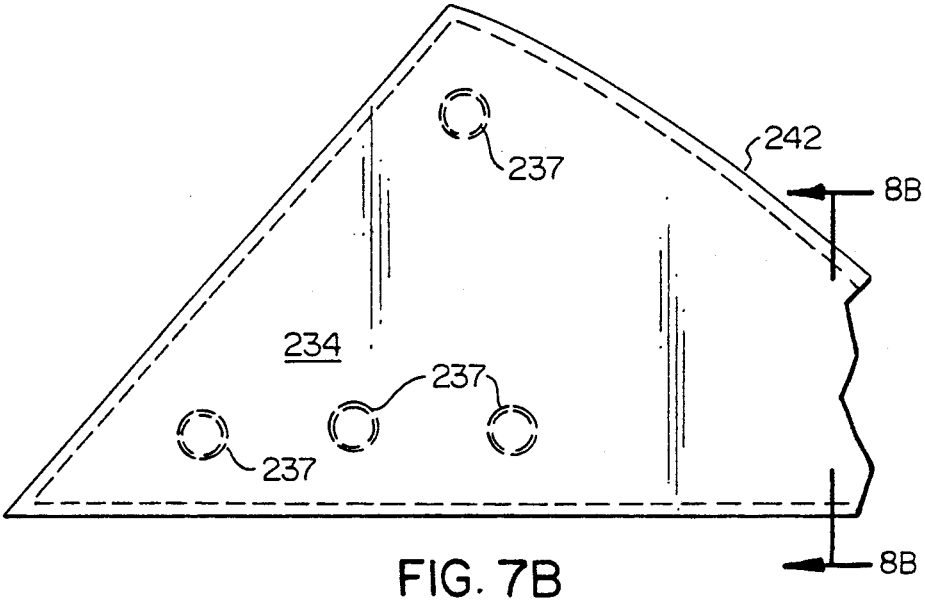
Figure 8A:
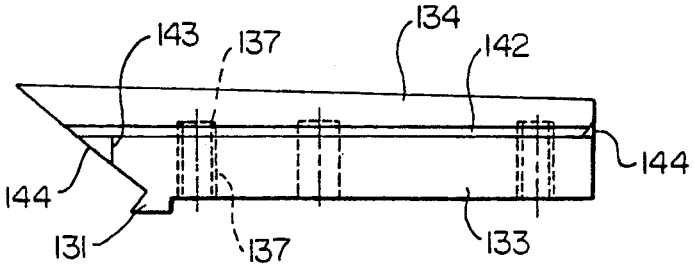
FIGS. 8A and 8B are respective sectional views taken along 8A—8A of FIG. 7A and 8B—8B of FIG. 7B.
Figure 8B:
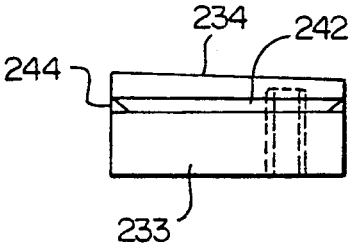

Another embodiment is shown in FIG. 7A and 7B, with additional reference to FIGS. 8A and 8B. This knife assembly can be employed on very large machines. Here, each segment is formed as two separate sub-segment pieces which fit together to form a segmental pie wedge shape. Each knife holder portion 122, 222 is formed of a respective base plate 133,233 and wear plate 134, 234. Aligned bores 136, 137 are formed in the base plate 133 and wear plate 134, and aligned bores 236, 237 are formed in the base plate 233 and wear plate 234. The base plate 133 is provided with a cutout 143, and a peripheral chamfer 142, 242 is provided for each of the wear plates 134, 234. The installation of the wear plates onto the base plates, and the replacement of wear plates, is similar to that described previously and need not be discussed in detail.

While this invention has been described in detail with reference to certain preferred embodiments, it should be understood that the invention is not limited to those embodiments precisely. Rather, many modifications and variations would present themselves to those of skill in the art without departing from the scope and spirit of this invention, as defined in the appended claims.

What is claimed is:

1. Apparatus for cutting logs into wood chips, including a rotary cutting disk, a plurality of radially disposed knife assemblies secured into a proximal face of said rotary disk, each knife assembly being disposed adjacent an entrance to a respective chip slot that passes axially through the disk, a plurality of segmental knife holders each occupying a segmental portion of the proximal side of the cutting disk and extending over an entire length of a said segmental portion to an adjacent chip slot from its associated knife assembly to clamp the knife assembly onto the disk, the knife holders each having a hardened helicoid proximal wear surface facing logs that are fed into the apparatus for chipping; and the improvement wherein each said knife holder comprises a base plate which removably mounts onto said disk and a wear plate replaceably affixed by welding onto a proximal face of the base plate and having a helicoid proximal surface on which is formed a hardfacing of a predetermined thickness.

2. Apparatus according to claim 1 wherein said wear plate has a peripheral chamfer on its distal side along at least one edge not adjacent said knife assembly, said chamfer receiving a weld bead for welding the periphery of the wear plate to the associated base plate.

3. Apparatus according to claim 1 wherein said wear plate is replaceably attached onto its associated base plate by welding the same along mating peripheries thereof.

4. Apparatus according to claim 1 wherein said base plate has a plurality of threaded bores therethrough and the associated wear plate has a like plurality of corresponding threaded bores therein extending from the distal surface partway to the proximal surface and in registry with the base plate threaded bores, and further comprising a plurality of threaded set screw members each fitting in a respective one of the base plate threaded bores and the corresponding one of the wear plate threaded bores.

5. Apparatus according to claim 1 wherein each of the wear plate and base plate is formed of two mating sub-segments which fit together on the cutting disk to form one of said segmental knife holders.

6. Apparatus according to claim 1 wherein said base plate has a planar proximal surface and said wear plate has a mating planar distal surface.

7. Apparatus according to claim 1 wherein said wear plate is formed of mild steel with said hard facing being formed on its proximal surface with a thickness of 0.020 to 0.050 inches.

8. Apparatus according to claim 1 wherein said hand facing is formed by a thermal spray treatment with powdered tungsten carbide.

* * * * *